US009213302B2

(12) United States Patent
Hashimoto

(10) Patent No.: US 9,213,302 B2
(45) Date of Patent: Dec. 15, 2015

(54) IMAGE FORMING APPARATUS HAVING MECHANISM FOR RESTRICTING MOVEMENT OF COVER

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/306,759

(22) Filed: Jun. 17, 2014

(65) Prior Publication Data

US 2014/0376959 A1 Dec. 25, 2014

(30) Foreign Application Priority Data

Jun. 21, 2013 (JP) ..... 2013-130862

(51) Int. Cl.
*G03G 15/00* (2006.01)
*G03G 21/16* (2006.01)
*G03G 15/01* (2006.01)

(52) U.S. Cl.
CPC ..... *G03G 21/1628* (2013.01); *G03G 15/0178* (2013.01); *G03G 21/1633* (2013.01); *G03G 2221/1654* (2013.01)

(58) Field of Classification Search
CPC ..... G03G 21/1628; G03G 21/1633; G03G 15/0178; G03G 2221/1654
USPC ..... 399/125, 110, 114
See application file for complete search history.

(56) References Cited

U.S. PATENT DOCUMENTS

| | | | | |
|---|---|---|---|---|
| 5,041,872 | A * | 8/1991 | Nukaya et al. | 399/107 |
| 7,715,753 | B2 | 5/2010 | Hisada | |
| 7,894,747 | B2 | 2/2011 | Hisada | |
| 2008/0253802 | A1 * | 10/2008 | Koyanagi et al. | 399/114 |
| 2008/0304860 | A1 | 12/2008 | Hisada | |
| 2010/0183352 | A1 | 7/2010 | Hisada | |
| 2011/0217075 | A1 * | 9/2011 | Uehara et al. | 399/114 |
| 2014/0016963 | A1 | 1/2014 | Hashimoto | |

FOREIGN PATENT DOCUMENTS

| | | | | |
|---|---|---|---|---|
| JP | 2002149037 | A * | 5/2002 | G03G 21/16 |
| JP | 2008-275805 | A | 11/2008 | |
| JP | 2014-016521 | A | 1/2014 | |

* cited by examiner

*Primary Examiner* — Billy Lactaoen
(74) *Attorney, Agent, or Firm* — Banner & Witcoff, Ltd.

(57) ABSTRACT

An image forming apparatus includes a main body, a cartridge supporting member, a cover and a restricting member. The cartridge supporting member supporting cartridges is movable along a moving path between an inside position and an outside position relative to the main body. The cover is provided at the main body and pivotally movable between a first position and a second position higher than the first position in a direction generally perpendicular to the moving path. The restricting member is movable in interlocking relation with the movement of the cartridge supporting member between a restricting position and a permitting position for restricting and permitting movement of the cover from the second position to the first position. The restricting member is in the restricting position when the cartridge supporting member is in the outside position, and in the permitting position when the cartridge supporting member is in the inside position.

14 Claims, 10 Drawing Sheets

IMAGE FORMING APPARATUS HAVING MECHANISM FOR RESTRICTING MOVEMENT OF COVER

CROSS REFERENCE TO RELATED APPLICATION

This application claims priority from Japanese Patent Application No. 2013-130862 filed Jun. 21, 2013. The entire content of the priority application is incorporated herein by reference.

TECHNICAL FIELD

The present invention relates an image forming apparatus provided with a cartridge supporting member for supporting a plurality of cartridges.

BACKGROUND

There is known a conventional image forming apparatus provided with a cartridge supporting member for supporting a plurality of cartridges. In this image forming apparatus, opening a cover (top cover) enables a moving path of the cartridge supporting member to be exposed outside (for example, see Japanese Patent Application Publication No. 2008-275085).

Specifically, in this image forming apparatus, a plurality of exposing members for exposing photosensitive members to light is attached to the cover. In a state where the cover is closed, some of the exposing members are disposed to be positioned on the moving path of the cartridge supporting member with each of the some of the exposing members positioned between neighboring cartridges. When the cover is opened, the exposing members are moved upward together with the cover and, thus, the moving path of the cartridge support member is opened (exposed).

SUMMARY

However, in the above-described image forming apparatus, if the cover comes down during detachment or attachment of the cartridge supporting member, movement of the cartridge supporting member is interrupted.

Therefore, it is an object of the present invention to provide a mechanism that can suppress a movement of a cartridge supporting member from being interrupted in an image forming apparatus whose cover is configured to be opened upward to expose a moving path of the cartridge supporting member.

In order to attain the above and other objects, there is provided an image forming apparatus that may include a main body, a cartridge supporting member, a cover provided at the main body, and a restricting member. The cartridge supporting member is configured to support a plurality of cartridges and is movable along a moving path between an inside position inside the main body and an outside position outside of the main body. The cover is pivotally movable between a first position and a second position higher than the first position in a height direction generally perpendicular to the moving path. The restricting member is configured to move in interlocking relation with the movement of the cartridge supporting member, the restricting member being movable between a restricting position for restricting movement of the cover from the second position to the first position and a permitting position for permitting the movement of the cover from the second position to the first position, the restricting member being configured such that the restricting member is placed in the restricting position when the cartridge supporting member is in the outside position and such that the restricting member is placed in the permitting position when the cartridge supporting member is in the inside position.

DETAILED DESCRIPTION

1. First Embodiment

A color printer 1 is an example of an image forming apparatus according to a first embodiment of the present invention. First, a general structure of the color printer 1 will be described with reference to FIG. 1.

Throughout the specification, the terms "above", "below", "right", "left", "front", "rear" and the like will be used assuming that the color printer 1 is disposed in an orientation in which it is intended to be used. More specifically, in FIG. 1, a left side, a right side, a near side and a far side of the color printer 1 are referred to as a front side, a rear side, a right side and a left side, respectively.

Figure 1:
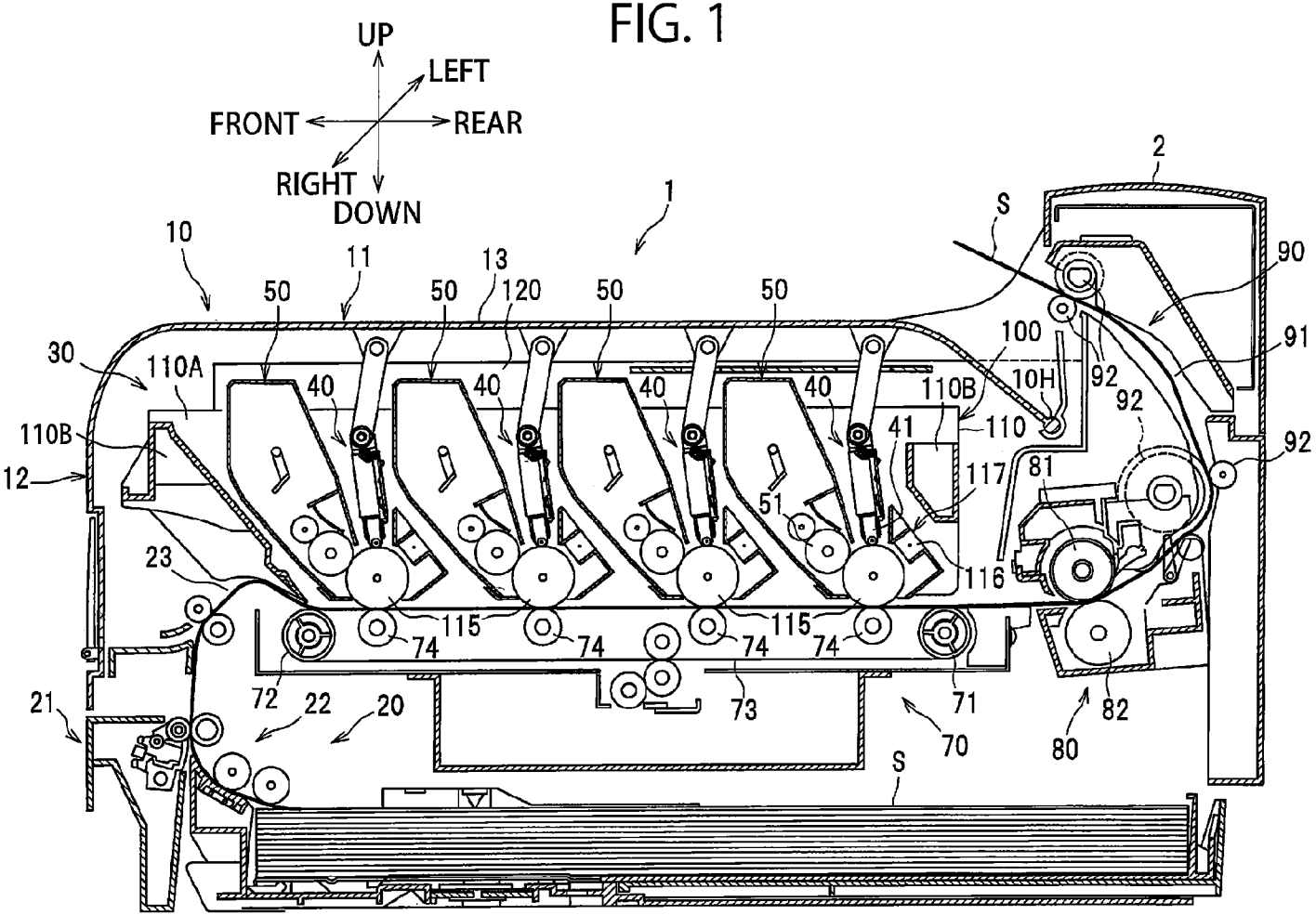
FIG. 1 is a schematic cross-sectional view illustrating a general configuration of a color printer according to a first embodiment of the present invention, the color printer including a cartridge supporting member.

As shown in FIG. 1, a color printer 1 includes a main casing 2 as an example of a main body. Within the main casing 2 provided are a sheet supply section 20 configured to supply sheets of paper S, an image forming section 30 configured to form an image on the supplied sheet of paper S, and a sheet discharge section 90 configured to discharge the sheet of paper S on which the image has been formed.

The image forming section 30 includes an image forming unit 100 capable of being withdrawn frontward from the main casing 2.

An openable/closable cover 10 is provided at an upper portion of the main casing 2. The cover 10 is pivotally movable about a hinge 10H provided at a rear end thereof such that a front end portion of the cover 10 is pivotally movable upward and downward about the hinge 10H. Specifically, the cover 10 is configured to move between a first position where the main casing 2 is closed with the cover 10 (shown in FIG. 1) and a second position (shown in FIG. 2) higher than the first position where the image forming unit 100 can be withdrawn from an inside position to an outside position with respect to a front-rear direction. In the second position (i.e., when opened upward), the cover 10 is configured to be locked by restricting members 200 as will be described later.

The cover 10 integrally includes a top cover 11 and a front cover 12 as an example of a covering portion. In the first position, the cover 10 is configured to cover the image forming unit 100 in the inside position from above, and the front cover 12 is configured to cover a front end portion of the image forming unit 100 in the inside position. Here, the front end portion of the image forming unit 100 corresponds to a downstream end portion (a leading side) of the image forming unit 100 in a direction in which the image forming unit 100 is displaced from the inside position to the outside position.

The top cover 11 has an upper surface serving as a sheet discharge tray 13 configured to receive the sheets of paper S discharged from the main casing 2. The top cover 11 has a lower surface to which four LED units 40 (as an example of an exposing member) are fixed.

The sheet supply section 20 is provided at a lower portion of the main casing 2. The sheet supply section 20 includes a sheet supply tray 21 and a sheet supply mechanism 22. The sheet supply tray 21 is configured to be detachably attachable to the lower portion of the main casing 2. The sheet supply mechanism 22 is configured to feed the sheets of paper S from the sheet supply tray 21 to the image forming section 30. In the sheet supply section 20, the sheets of paper S in the sheet supply tray 21 are separated one by one and are then fed upward one sheet S a time. The sheet of paper S fed upward is conveyed along a sheet conveying path 23 and is then rearward to be supplied to the image forming section 30.

The image forming section 30 includes the image forming unit 100, the four LED units 40, a transfer unit 70, and a fixing unit 80.

The image forming unit 100 includes a cartridge supporting member 110 configured to support four photosensitive drums 115 (as an example of a photosensitive body) and four developing cartridges 50 (as an example of a cartridge) juxtaposed in the front-rear direction.

The cartridge supporting member 110 is configured to be supported by rails (not illustrated) respectively provided in left and right side frames 120 (see FIG. 2) provided in the main casing 2. The rails extend in the front-rear direction. Thus the cartridge supporting member 110 is configured to move in a direction in which the photosensitive drums 115 are juxtaposed, that is, in the front-rear direction. Specifically, the cartridge supporting member 110 (image forming unit 100) is movable between the inside position accommodated inside the main casing 2 and the outside position (FIG. 2) displaced from the inside position to a position outward relative to the main casing 2. Note that, the outside position in the present embodiment refers to a position at which all the developing cartridges 50 can be attached to and detached from the cartridge supporting member 110.

The cartridge supporting member 110 is formed in a frame-like shape. The cartridge supporting member 110 includes a pair of side walls 110A extending in the front-rear direction and two cross beams 110B connecting between front and rear ends of the side walls 110A respectively. The side walls 110A are positioned on both sides (left and right sides) of the photosensitive drums 115 in an axial direction thereof. Between the left and right side walls 110A, four photosensitive member units 117 are supported. Each photosensitive member unit 117 includes one of the photosensitive drums 115 and a charger 116.

The side frames 120 of the main casing 2 are respectively provided outward (rightward and leftward) of the image forming unit 100 in the axial direction of the photosensitive drums 115 (in the left-right direction).

The developing cartridges 50 are configured to accommodate toner therein. Each of the four developing cartridges 50 includes a developing roller 51 corresponding to each of the photosensitive drums 115. The developing cartridge 50 can be attached to and detached from the cartridge supporting member 110 from above.

The LED units 40 are provided to correspond to the photosensitive drums 115 respectively. Each LED unit 40 includes an LED array 41 for exposing the corresponding photosensitive drum 115 to light. The LED array 41 has a lower end surface on which light emitting elements configured of LEDs (not illustrated) are arranged in the axial direction of the photosensitive drum 115. The LED array 41 is disposed substantially above and in proximity to the corresponding photosensitive drum 115. The LED array 41 is disposed adjacent to and rearward of the corresponding developing cartridge 50. In other words, of the four LED units 40, the three LED units 40 from the front are disposed between the four developing cartridges 50 when the cover 10 is in the first position (i.e., closed, see FIG. 1). Each of these three LED units 40 is disposed between neighboring two of the developing cartridges 50.

The transfer unit 70 is disposed between the sheet supply section 20 and image forming unit 100. The transfer unit 70 includes a driving roller 71, a driven roller 72, a conveying belt 73, and four transfer rollers 74.

The driving roller 71 and driven roller 72 are disposed to be spaced away from and in parallel to each other. The conveying belt 73 is an endless belt mounted on and over the driving roller 71 and driven roller 72. The conveying belt 73 has an outer surface that contacts each of the four photosensitive drums 115. The four transfer rollers 74 are disposed in an internal space defined by the conveying belt 73 to correspond to the respective photosensitive drums 115. Thus the transfer rollers 74 and the corresponding photosensitive drums 115 nip the conveying belt 73 therebetween. During transfer operations, a transfer bias is applied to each transfer roller 74 under constant current control.

The fixing unit 80 is disposed rearward of the image forming unit 100 and transfer unit 70. The fixing unit 80 includes a heating roller 81 and a pressure roller 82 configured to press the heating roller 81.

In the image forming section 30, a surface of each photosensitive drum 115 is uniformly charged by the corresponding charger 116 and then exposed by LED light emitted from the corresponding LED unit 40. Thus, a potential at an exposed portion on the surface of the photosensitive drum 115 is lowered, thereby forming an electrostatic latent image thereon based on image data.

The toner stored in each developing cartridge 50 is configured to be carried on the corresponding developing roller 51 in a form of a thin layer. The toner is then supplied to the electrostatic latent image formed on the corresponding photosensitive drum 115 while the developing roller 51 faces and contacts the photosensitive drum 115. As a result, the toner is selectively carried on each photosensitive drum 115 to develop the electrostatic latent image into a visible toner image though a reversal phenomenon.

While the sheet of paper S supplied onto the conveying belt 73 passes between each photosensitive drum 115 and the corresponding transfer roller 74 disposed at the internal space of the conveying belt 73, the toner image carried on each of the photosensitive drums 115 is transferred onto the sheet of paper S.

Then in the fixing unit 80, the toner image transferred onto the sheet of paper S is thermally fixed thereon while the sheet of paper S passes between the heating roller 81 and pressure roller 82.

The sheet discharge section 90 includes a discharge-side conveying path 91 and a plurality of pairs of conveying rollers 92. The discharge-side conveying path 91 extends upward from an outlet of the fixing unit 80 and then makes a U-turn frontward. The image-formed sheet of paper S is conveyed by the conveying rollers 92 along the discharge-side conveying path 91, and is discharged outside the main casing 2 onto the sheet discharge tray 13.

Next, detailed configurations of the cover 10 and the restricting member 200 will be described with reference to FIGS. 2 through 7.

Figure 2:
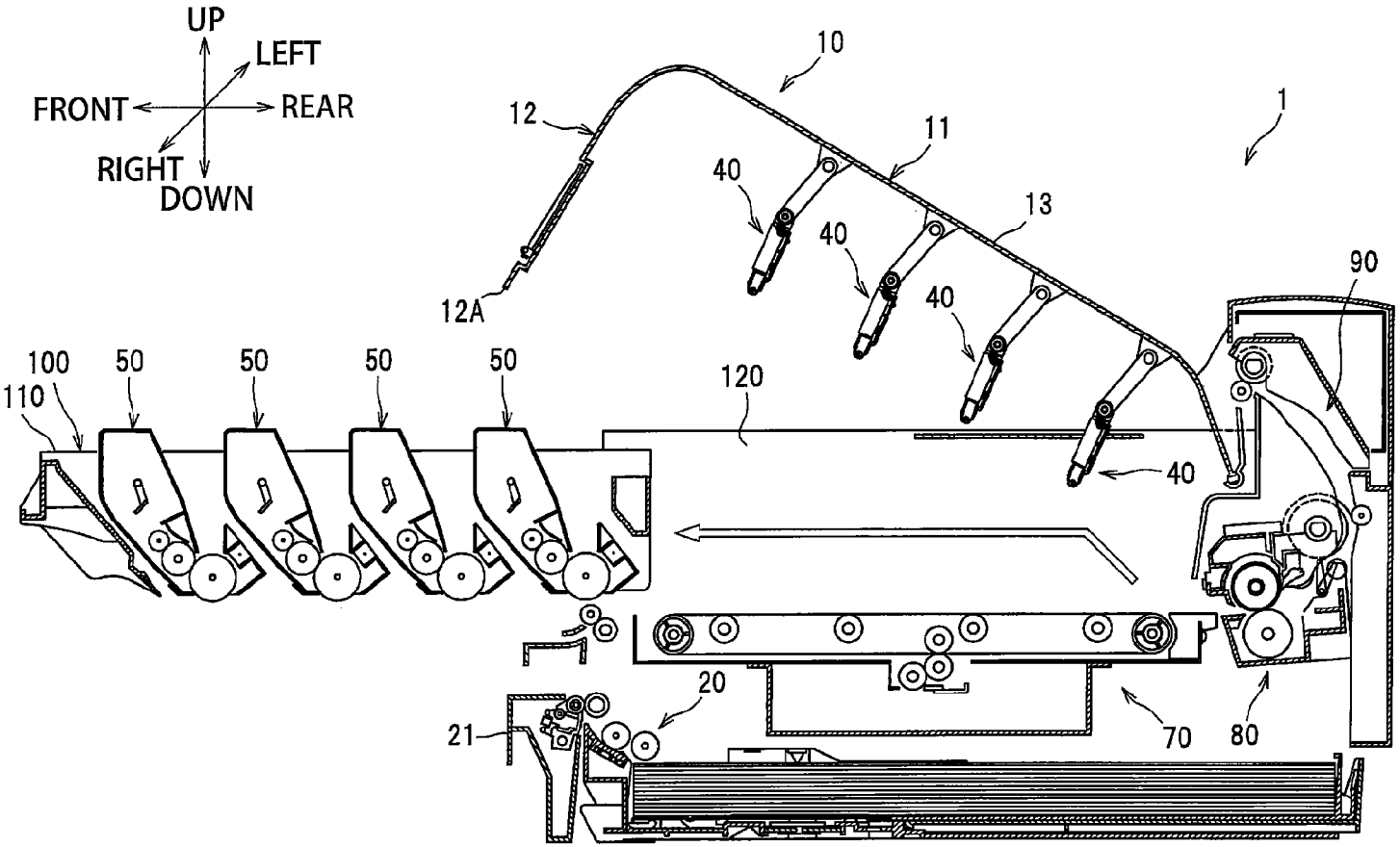
FIG. 2 is a view illustrating a state where the cartridge supporting member is withdrawn from a main casing of the color printer according to the first embodiment.

As illustrated in FIG. 2, the upwardly opened cover 10 (in the second position) permits attachment/detachment of the image forming unit 100. When the cover 10 is in the second position, a lower end 12A of the front cover 12 is positioned above the image forming unit 100. Hence, the front cover 12 is positioned not to overlap with the image forming unit 100 when viewed from the front side of the color printer 1, that is, in a direction in which the image forming unit 100 is withdrawn, i.e., from the rear side toward the front side. Further, in this state, the three LED units 40 other than the rearmost LED unit 40, which are disposed most upstream in the direction of the cartridge supporting member 110 moving from the inside position to the outside position, are positioned not to overlap with the image forming unit 100 in the moving direction of the image forming unit 100 (cartridge supporting member 110) from the inside position to the outside position.

With this construction, when the cover 10 is in the second position, the cover 10 and LED units 40 can be positioned so as not to interrupt the movement of the image forming unit 100 between the inside position and outside position. That is, moving the cover 10 from the first position to second position allows the image forming unit 100 to move. Note that, in FIGS. 3 and 4, the LED units 40 are omitted for a facilitating understanding of the present invention.

Figure 3A:
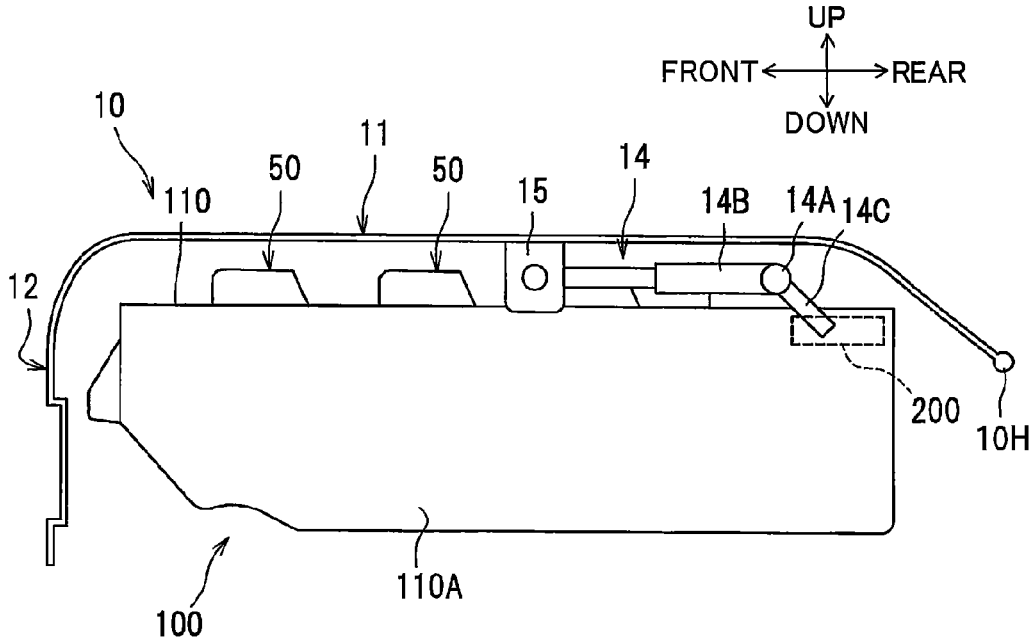
FIG. 3A is a side view showing a cover and a right arm according to the first embodiment in a state where the cover is closed.
Figure 3B:
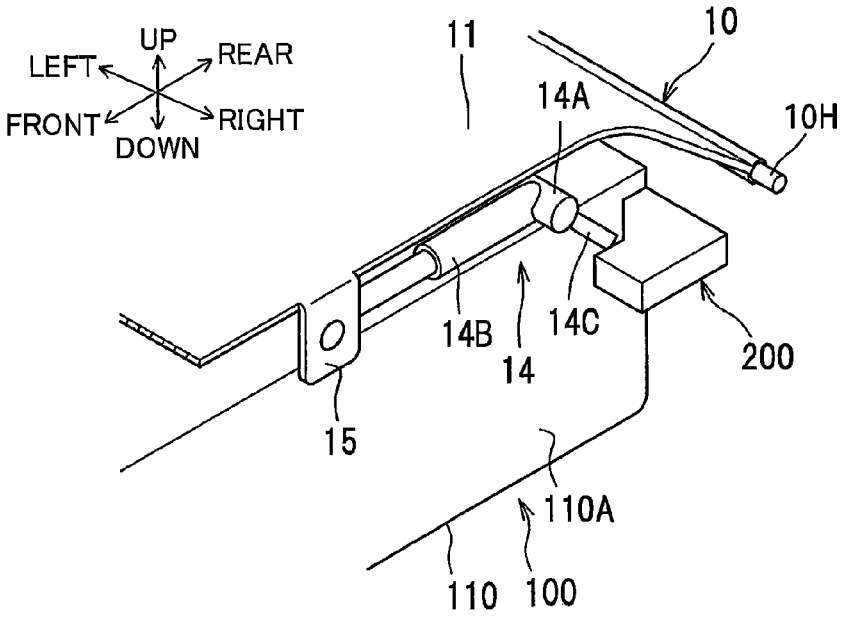
FIG. 3B is a perspective view showing the cover and the right arm according to the first embodiment in a state where the cover is closed.

As illustrated in FIGS. 3A and 3B, the cover 10 is provided with left and right arms 14 that connects the top cover 11 to the main casing 2 (only the right arm 14 is illustrated) as an example of an arm unit. Each arm 14 includes a shaft portion 14A (as an example of a shaft portion), a damper 14B (as an example of a damper portion) and a restricted portion 14C fixed to the shaft portion 14A (as an example of a restricted portion). The shaft portion 14A is rotatably supported to the main casing 2. The damper 14B connects the shaft portion 14A and the top cover 11. The restricted portion 14C is fixed to the shaft portion 14A.

The damper 14B has a well-known structure and is configured to generate a biasing force in a direction in which the damper 14B extends. Thus the damper 14B can expand and contract within a predetermined range. The damper 14B has one end portion fixed to the shaft portion 14A, and another end pivotably movably connected to one of extending portions 15 that extends downward from left and right end portions of the top cover 11. Preferably, the dampers 14B are designed to contract to such a degree that the LED units 40 and front cover 12 are not brought into contact with the image forming unit 100 when the cover 10 is pushed downward while the restricting members 200 lock the pivotal movement of the arms 14.

Figure 4A:
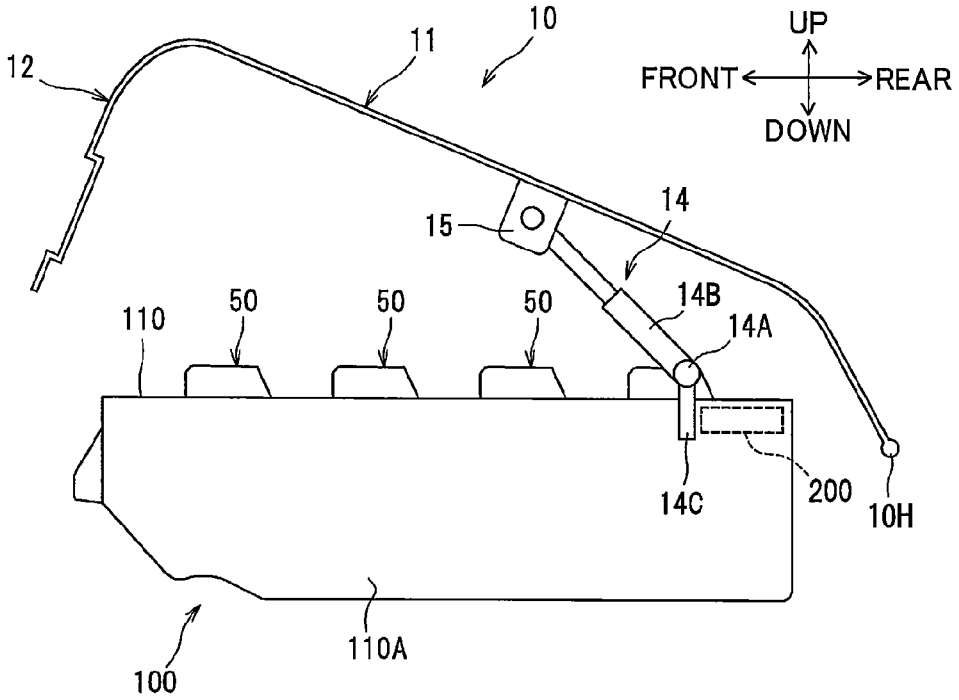
FIG. 4A is a side view showing the cover and the right arm according to the first embodiment in a state where the cover is opened.
Figure 4B:
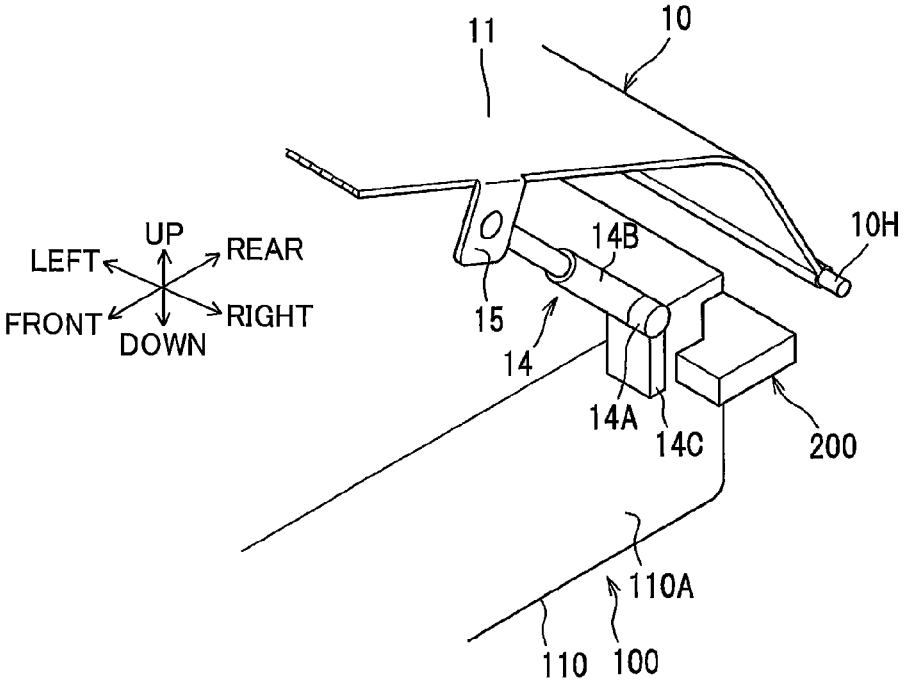
FIG. 4B is a perspective view showing the cover and the right arm according to the first embodiment in a state where the cover is opened.

The restricted portion 14C has a substantially rectangular plate-like shape and extends radially outward from a peripheral surface of the shaft portion 14A. As shown in FIGS. 3B and 4B, the restricted portion 14C is positioned outward of the corresponding side wall 110A of the cartridge supporting member 110 in the left-right direction. As illustrated in FIGS. 4A and 4B, when the cover 10 is in the second position, the restricted portion 14C is designed to extend substantially vertically downward from the shaft portion 14A.

The restricting members 200 serve to restrict opening and closing of the cover 10. The restricting members 200 are provided respectively to correspond to the left and right arms 14 (only the restricting member 200 for the right arm 14 is illustrated). The restricting members 200 are positioned outward of a rear end portion of the cartridge supporting member 110 in the inside position in the left-right direction (see FIG. 5). Here, the rear end portion corresponds to a portion of the cartridge supporting member 110 positioned most downstream in a moving direction of the cartridge supporting member 110 from the outside position to the inside position.

Figure 5:
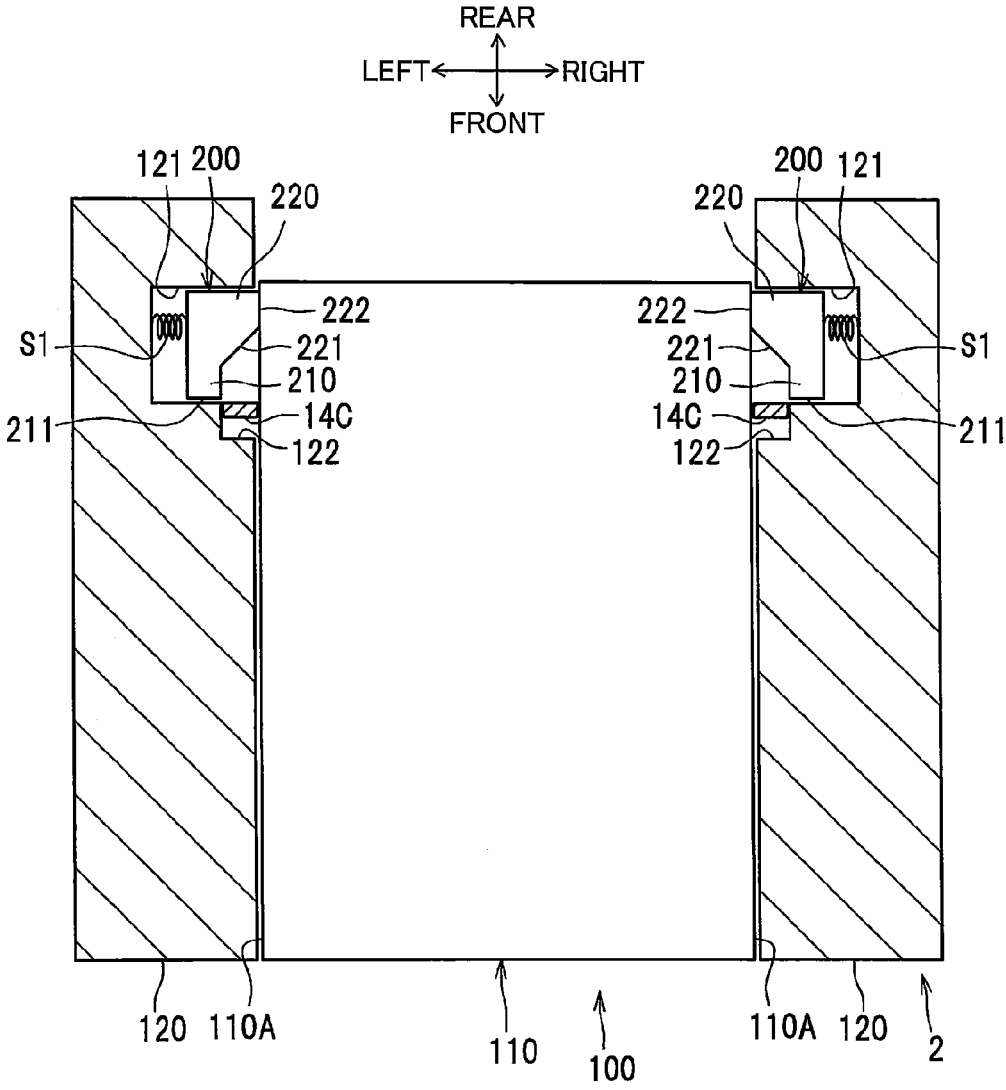
FIG. 5 is a cross-sectional view illustrating restricting members of the first embodiment when the cartridge supporting member is in an inside position.

As illustrated in FIG. 5, the restricting member 200 has a substantially L-shape in a plan view. Each restricting member 200 has a first portion 210 elongated in the front-rear direction and a second portion 220 protruding inward in the left-right direction from a rear end portion of the first portion 210.

The first portion 210 has a front end surface facing frontward and serving as a lock surface 211. The second portion 220 has a substantially trapezoidal shape in a plan view. The second portion 220 has a pressed surface 221 (as an example of a pressed portion) facing frontward and an abutment surface 222 (as an example of an abutment surface) facing inward in the left-right direction.

Specifically, the pressed surface 221 is a sloped surface that approaches the cartridge supporting member 110 (inward in the left-right direction) toward rearward, i.e., toward downstream in the moving direction of the cartridge supporting member 110 from the outside position to the inside position. The abutment surface 222 extends rearward from an inner end (left or right end) of the pressed surface 221.

The restricting members 200 are received in first concave portions 121 (as an example of a guide portion) formed in respective side frames 120 of the main casing 2. Specifically, the first concave portions 121 are formed in left and right inner surfaces of the respective side frames 120. The first concave portions 121 are recessed inward in the left-right direction. Each first concave portion 121 has a front-rear dimension substantially the same as that of the first portion 210 of the restricting member 200. Each side frame 120 is also formed with a second concave portion 122 disposed adjacent to and frontward of the first concave portion 121. The second concave portion 122 is configured to receive the restricted portion 14C of the corresponding arm 14.

The restricting members 200 are configured to slide in the left-right direction while guided by inner surfaces (front and rear surfaces) of the corresponding first concave portions 121. Thus, the restricting member 200 are movable between a restricting position (FIG. 7) where the lock surfaces 211 are positioned rearward of the restricting portions 14C of the respective arms 14 and a permitting position (FIG. 5) retracted from the restricting position in the left-right direction where the lock surfaces 211 are not overlapped with (aligned with) the respective restricting portions 14C in the front-rear direction. That is, the restricting members 200 are configured to move in a direction intersecting the moving direction of the cartridge supporting member 110. For example, the moving direction of the restricting member 200 and the moving direction of cartridge supporting member 110 may form an angle ranging from 70 degrees to 110 degrees, more preferably an angle of 90 degrees.

Each restricting member 200 is biased toward the restricting position from the permitting position by a compression spring S1 (as an example of a biasing member) provided between the restricting member 200 and a bottom surface (left surface or right surface in FIG. 5) of the corresponding first concave portion 121. When the cartridge supporting member 110 is in the inside position, each abutment surface 222 abuts on a rear end portion of the corresponding side wall 110A and, thus, the restricting member 200 is maintained at the permitting position.

Operations and technical advantages of the above-configured color printer 1 will now be described.

For replacement of the developing cartridges 50, for example, the image forming unit 100 is withdrawn from the main casing 2. In order to pull out the image forming unit 100 from the main casing 2, the cover 10 is first pivotally moved upward from the first position to the second position as illustrated in FIG. 2, thereby exposing (opening) a moving path of the image forming unit 100.

In this state, as illustrated in FIGS. 4A and 4B, in accordance with the movement of the cover 10 to the second position, the dampers 14B expand and the arms 14 pulled by the cover 10 are caused to pivotally move about the respective shaft portions 14A in a clockwise direction in FIG. 4. The cover 10 is maintained at the second position by the arms 14 supporting the top cover 11.

Incidentally, when the cover 10 is in the second position, the restricting portions 14C of the arms 14 are positioned frontward of the second portions 220 of the corresponding restricting members 200, as illustrated in FIG. 5.

Figure 6:
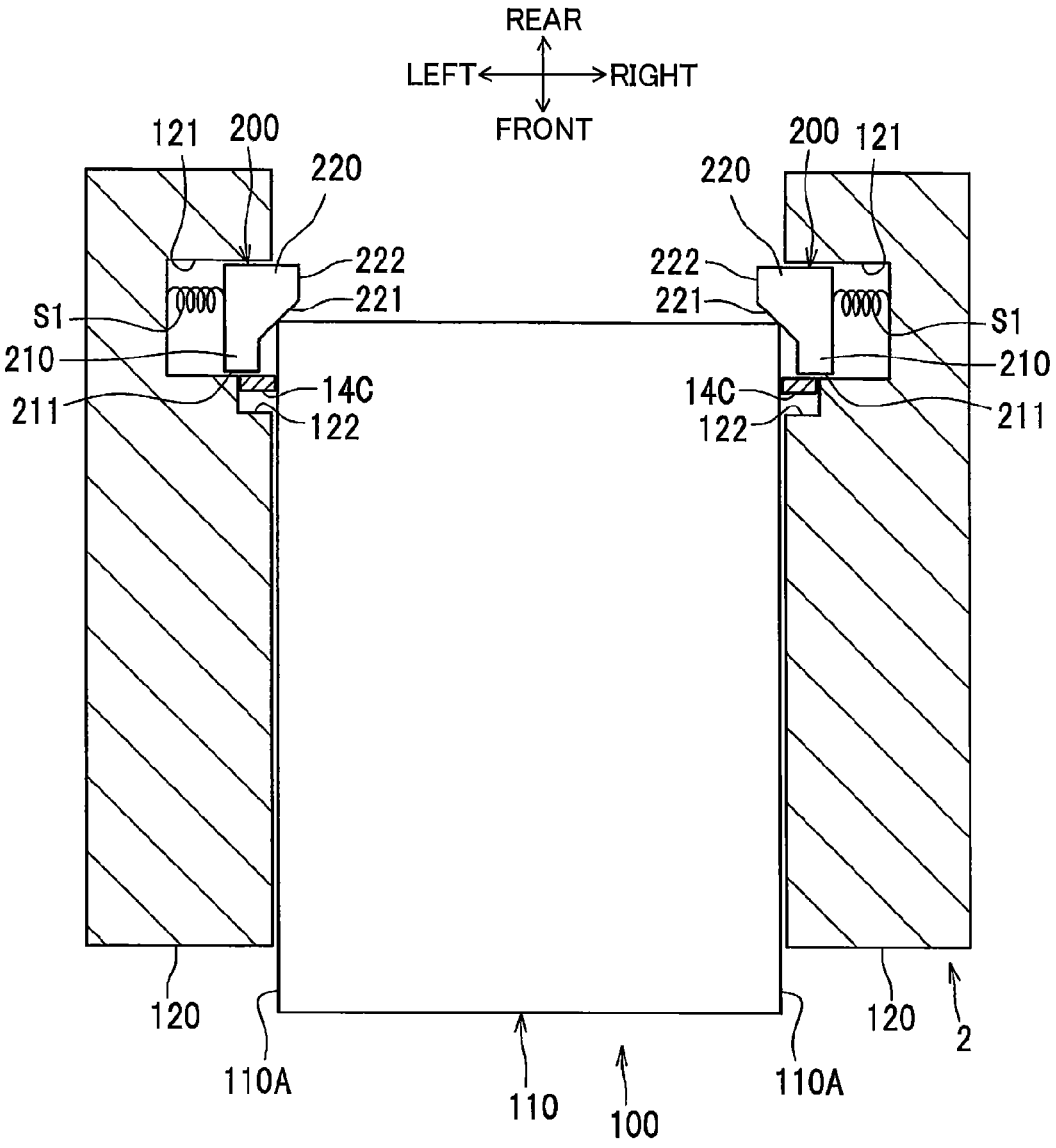
FIG. 6 is a cross-sectional view illustrating the restricting members of the first embodiment when the cartridge supporting member is withdrawn from the inside position.

Then, the cartridge supporting member 110 in the inside position is withdrawn frontward to the outside position. As the cartridge supporting member 110 is being moved (pulled) frontward, abutment between the abutment surfaces 222 of the restricting members 200 and side walls 110A of the cartridge supporting member 110 is released, and rear end corners of the cartridge supporting member 110 are brought into abutment with the pressed surfaces 221 of the respective restricting members 200, as illustrated in FIG. 6. As the cartridge supporting member 110 is pulled further frontward, each of the restricting members 200 is gradually displaced toward the restricting position due to the biasing force of the corresponding compression spring S1. At this time, the rear end corners of the cartridge supporting member 110 are pushed frontward by the sloped abutment surfaces 222 of the respective restricting members 200. Therefore, withdrawal of the cartridge supporting member 110 frontward can be performed with a smaller force.

Incidentally, in accordance with the movement of the restricting members 200 toward the restricting position, the lock surfaces 211 of the restricting members 200 start moving inward in the left-right direction while being positioned rearward of the restricting portions 14C of the corresponding arms 14 in the front-rear direction. Thus, during the movement of the restricting members 200 from the allowing position to the restricting position, a portion of each lock surface 211 is positioned rearward of the corresponding restricted portion 14C (shown in FIG. 6).

Figure 7:
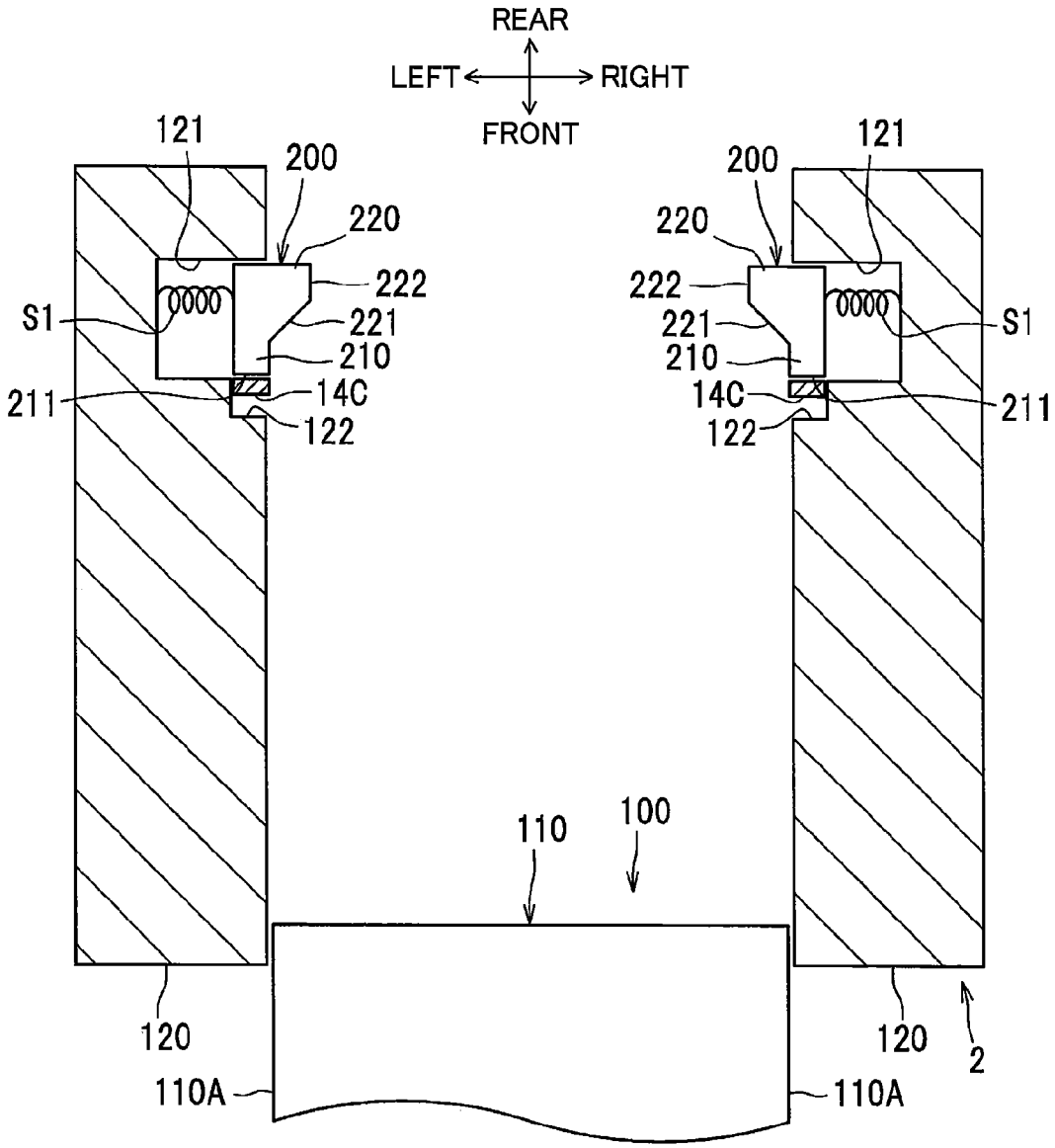
FIG. 7 is a cross-sectional view illustrating the restricting members of the first embodiment when the cartridge supporting member is in an outside position.

Then, as illustrated in FIG. 7, when the cartridge supporting member 110 has been displaced to a position fully frontward of the restricting members 200, the restricting members 200 reach the restricting position. Hence, each of the lock surfaces 211 as a whole is positioned rearward of the restricting portion 14C of the corresponding arm 14.

Since the lock surfaces 211 are positioned rearward of the restricted portions 14C of the arms 14, the restricted portions 14C are restricted from moving rearward. Hence, the arms 14 are prevented from pivotally moving in a counterclockwise direction in FIG. 4, thereby restricting the cover 10 from moving toward the first position from the second position.

In other words, the abutment surfaces 222 of the restricting members 200 are configured to abut on the rear end portion of the cartridge supporting member 110 in the inside position (the rear end portion is the portion positioned most downstream in the moving direction of the cartridge supporting member 110 from the outside position to the inside position). With this structure, the cover 10 can be locked at the second position while the cartridge supporting member 110 is displaced from the inside position toward the outside position.

When the restricting members 200 are in the restricting position, the pressed surfaces 221 are positioned on a path (locus) along which the cartridge supporting member 110 is configured to be displaced to the inside position from the outside position, as shown in FIG. 7. Thus, when the image forming unit 100 is moved from the outside position to inside position, the rear end portion of the cartridge supporting member 110 is ensured to abut against the pressed surfaces 221 of the restricting members 200 as illustrated in FIG. 6. Since the cartridge supporting member 110 can reliably abut on the restricting members 200 before being attached to the main casing 2, vigorous attachment of the cartridge supporting member 110 can be prevented.

When the cartridge supporting member 110 is moved toward the inside position with the pressed surfaces 221 being pressed against the cartridge supporting member 110, the restricting members 200 are pushed outward in the left-right direction toward the permitting position.

Then, when the cartridge supporting member 110 is located at the inside position, the side walls 110A of the cartridge supporting member 110 face the abutment surfaces 222 of the restricting members 200 and in abutment therewith, thereby moving the restricting members 200 to the permitting position.

Incidentally, the abutment surfaces 222 extend from the rear ends of the corresponding pressed surfaces 221. Thus contact surface of each restricting member 200 with the cartridge supporting member 110 can be switched smoothly from the pressed surface 221 to the abutment surface 222 while the cartridge supporting member 110 is being displaced to the inside position. This structure also prevents the cartridge supporting member 110 from getting stuck with the restricting members 200.

When the restricting members 200 are in the permitting position, the lock surface 211 of each restricting member 200 is positioned not to be aligned with (offset from) the restricted portion 14C of the corresponding arm 14 in the front-rear direction, as illustrated in FIG. 5. The restricted portions 14C are therefore permitted to move rearward, thereby enabling the arms 14 to pivotally move counterclockwise in FIG. 4A. The locked state of the cover 10 by the arms 14 is released, and the cover 10 is thus movable to the first position (close) from the second position (open).

Further, the abutment surfaces 222 of the restricting members 200 are configured to abut against the end portion (rear end portion) of the cartridge supporting member 110 that is positioned most downstream in the attachment direction (the moving direction of the cartridge supporting member 110 from the outside position to the inside position). With this structure, the cover 10 can be maintained at the second position (in a locked state) until immediately before the cartridge supporting member 110 reaches the inside position.

Further, when the cartridge supporting member 110 is in the inside position, the direction in which the restricting members 200 push the side walls 110A of the cartridge supporting member 110 is substantially perpendicular to the moving direction of the cartridge supporting member 110. This structure of the restricting members 200 can reliably prevent the cartridge supporting member 110 from moving.

Further, the restricting members 200 are configured to press the cartridge supporting member 110 from both sides in the left-right direction. The cartridge supporting member 110 can therefore be positioned at a center with respect to the left-right direction by the restricting members 200.

As described above, the restricting members 200 are configured to move between the restricting position and the permitting position in association with the movement of the cartridge supporting member 110 between the inside position and the outside position. The cover 10 is configured to be locked at the second position while the cartridge supporting member 110 is being displaced or when the cartridge supporting member 110 is at the outside position. This structure can suppress the cover 10 or LED units 40 from interfering with the cartridge supporting member 110. Further, the cover 10 can be moved back to the first position for closing the main casing 2 when the cartridge supporting member 110 is in the inside position.

2. Second Embodiment

Next, a color printer 1A according to a second embodiment of the present invention will be described with reference to FIGS. 8A through 9B, wherein like parts and components are designated by the same reference numerals with those of the first embodiment in order to avoid duplicating description. Further, for facilitating understanding, the LED units 40 are omitted in FIGS. 8A and 8B.

The restricting members 200 according to the first embodiment are configured to slide in the left-right direction. However, restricting members 300 of the second embodiment are configured to pivotally move, as shown in FIGS. 8A and 8B.

More specifically, the color printer 1A of the second embodiment includes a cover 10A provided with a pair of restricted portions 16 (as an example of a restricted portion), and a pair of the restricting members 300. The restricting members 300 and the restricted portions 16 function to lock the cover 10A in the second embodiment. The restricted portions 16 are provided on left and right end portions of the cover 10A. The restricting members 300 are provided in the main casing 2 respectively at positions corresponding to the left and right end portions of the cover 10A.

Figure 8A:
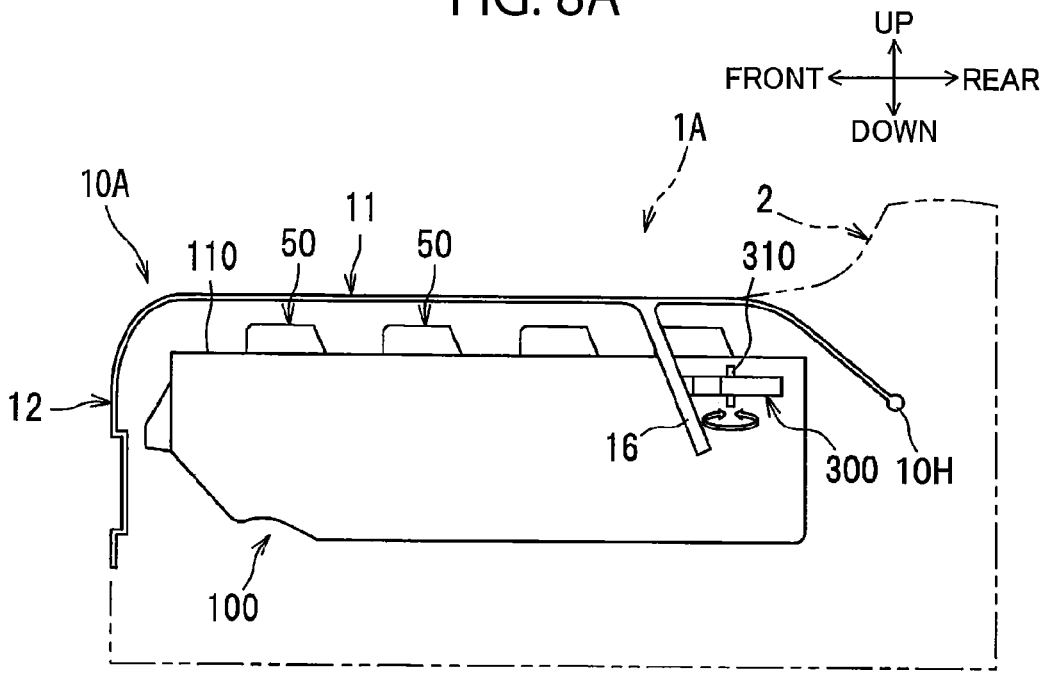
FIG. 8A is a view illustrating a cover and a restricting member according to a second embodiment of the present invention, wherein the cover is in a closed state.
Figure 8B:
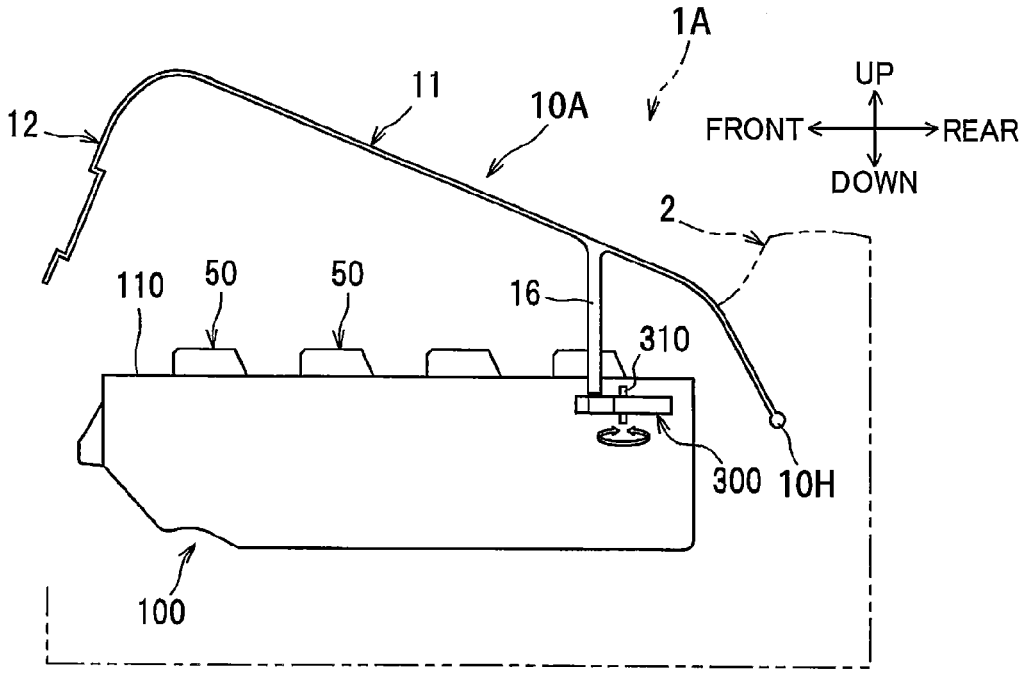
FIG. 8B is a view illustrating the cover and the restricting member according to the second embodiment of the present invention, wherein the cover is in an open state.

The restricted portions 16 are formed in a rod-like shape and extend generally downward from each of the left and right end portions of the top cover 11A (only the restricted portion 16 on the right side is shown in FIGS. 8A and 8B). As illustrated in FIG. 8B, when the cover 10A is pivotally moved upward to be in the second position, the restricted portions 16 extend substantially vertically and are respectively positioned outward of the rear end portion of the cartridge supporting member 110 in the inside position in the left-right direction.

Each of the restricting members 300 is supported to the main casing 2 so as to be pivotably movable about a shaft portion 310 provided at the main casing 2 and extending in an up-down direction (as an example of a shaft portion). The restricting members 300 are configured to be positioned below the corresponding restricted portions 16 when the cover 10 is in the second position (see FIG. 8B).

Figure 9A:
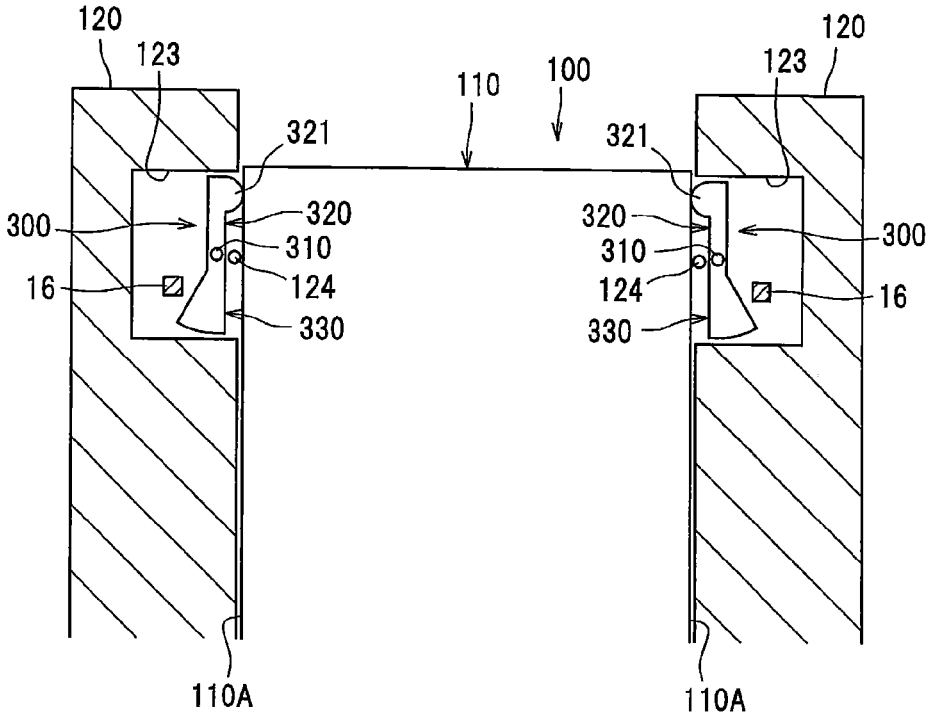
FIG. 9A is a view illustrating the restricting members of the second embodiment when the cartridge supporting member is in the inside position.

More specifically, as shown in FIG. 9A, each restricting member 300 includes a first arm 320 extending rearward from the shaft portion 310 and a second arm 330 extending frontward from the shaft portion 310.

The first arm 320 has a free end portion (rear end portion) provided with an abutment portion 321 (as an example of the pressed portion and a free end portion) protruding inward in the left-right direction. The second arm 330 has a fan-like shape in a plan view and spreading out toward a leading end (front end) thereof.

Each restricting member 300 with the above-described structure is housed in a concave portion 123 formed in each side frame 120 of the main casing 2. The restricting member 300 is therefore pivotally movable between a restricting position (shown in FIG. 9B) where the second arm 330 is positioned below the corresponding restricted portion 16 and an permitting position (shown in FIG. 9A) where the restricting member 300 is retracted from the restricting position and the second arm 330 is offset from (not aligned with) the corresponding restricted portion 16 in the up-down direction.

Figure 9B:
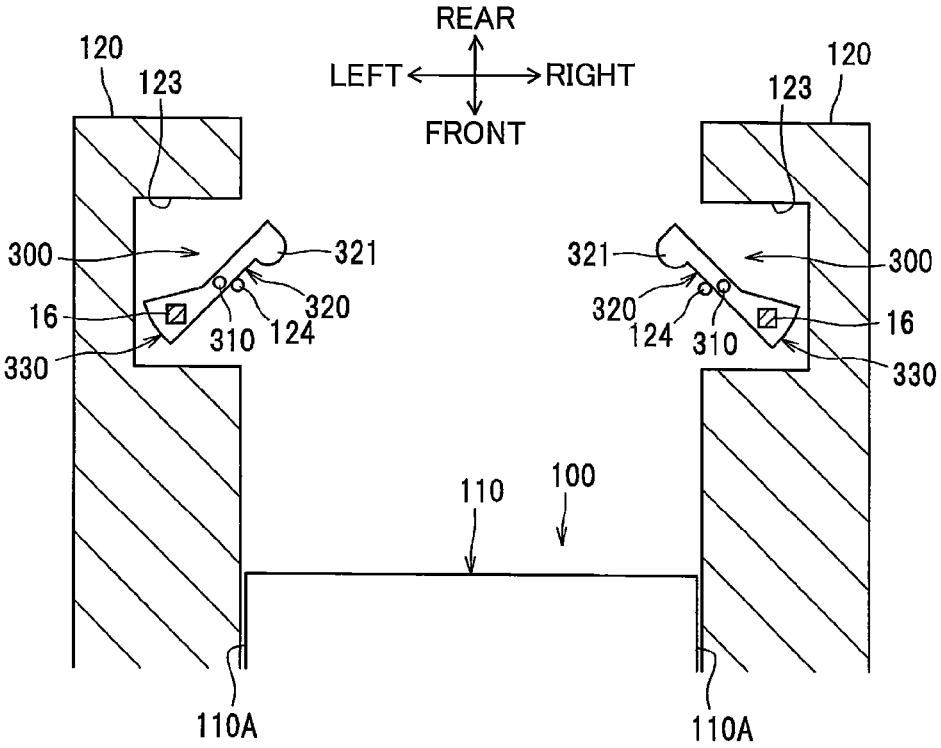
FIG. 9B is a view illustrating the restricting members of the second embodiment when the cartridge supporting member is in the outside position.

Further, the restricting members 300 are respectively biased by biasing members (not shown) from the permitting position toward restricting position, i.e., in a counterclockwise direction in FIGS. 9A and 9B in case of the right restricting member 300. That is, in each restricting member 300, an inner end face of the first arm 320 (right or left end face of the first arm 320) corresponds to a downstream portion of the first arm 320 in a direction in which the restricting member 300 is biased.

A stopper 124 is provided in each side frame 120. As illustrated in FIG. 9B, the downstream portion (inner end face) of each first arm 320 in the biased direction of the restricting member 300 is configured to abut on the corresponding stopper 124. Thus, due to the abutment of the first arms 320 and the stoppers 124, the restricting member 300 are can be maintained at the restricting position.

Operations and technical advantages of the color printer 1A will now be described.

When the cartridge supporting member 110 is attached to the main casing 2 as shown in FIG. 9A, the restricting members 300 are in the permitting position where the abutment portions 321 of respective first arms 320 are in abutment with the respective side walls 110A of the cartridge supporting member 110. At this time, the abutment portions 321 abut on the rear end portion of each side wall 110A.

Then, the cover 10A is pivotally moved upward and is placed at the second position. The cartridge supporting member 110 is then pulled out frontward toward the outside position. As a result, the abutment between the abutment portions 321 of the restricting members 300 and side walls 110A of the cartridge supporting member 110 is released, as shown in FIG. 9B. The restricting members 300 are accordingly pivotally moved toward the restricting position by biasing forces of the biasing members.

When the restricting members 300 reach the restricting position, the second arms 330 are positioned below the respective restricted portions 16 of the cover 10A. Therefore, even if the restricted portions 16 are attempted to be moved downward with the restricting members 300 in the restricting position, the restricted portions 16 (lower ends of the restricted portions 16) are brought into abutment with the second arms 330 of the respective restricting members 300. Thus, downward movement of the cover 10A, or movement of the cover 10A toward the first position is restricted by the abutment of the restricted portions 16 against the restricting members 300. This structure can therefore prevent interference of the cover 10A and LED units 40 with the image forming unit 100 withdrawn from the main casing 2.

When the restricting members 300 are in the restricting position, the abutment portions 321 of the first arms 320 protrude from the concave portions 123 of the side frames 120 and thus fall on the moving path of the cartridge supporting member 110. Thus, as the cartridge supporting member 110 is being moved from the outside position to inside position in this state, the rear end portion of the cartridge supporting member 110 is brought into abutment with the abutment portions 321 immediately before the cartridge supporting member 110 reaches the inside position. As a result of abutment with the cartridge supporting member 110, the abutment portions 321 are pushed rearward, thereby pivotally moving the restricting members 300 toward the permitting position, as illustrated in FIG. 9A. The cover 10A is therefore permitted to be displaced to the first position.

When the cartridge supporting member 110 is in the inside position, the abutment portions 321 of the restricting members 300 are in abutment with the side walls 110A of the cartridge supporting member 110, as described above. Incidentally, at this time, the abutment portions 321 in abutment with the cartridge supporting member 110 are biased to try to move inward in the left-right direction. Thus, the direction in which the abutment portions 321 try to move is perpendicular to the moving direction of the cartridge supporting member 110. Thus, the restricting members 300 of the second embodiment can effectively act on the cartridge supporting member 110 in the inside position and reliably suppress the cartridge supporting member 110 from moving in the front-rear direction.

3. Third Embodiment

Next, a color printer 1B according to a third embodiment of the present invention will be described with reference to FIGS. 10A and 10B, wherein like parts and components are designated by the same reference numerals with those of the first embodiment in order to avoid duplicating description. Further, for facilitating understanding, the LED units 40 are omitted in FIGS. 10A and 10B.

In the above-described first and second embodiments, the restricting members 200 and 300 are provided in the main casing 2. On the other hand, in the third embodiment, a pair of restricting members 400 is provided in a cover 10B of the color printer 1B as illustrated in FIGS. 10A and 10B (only one of the restricting members 400 is shown).

Figure 10A:
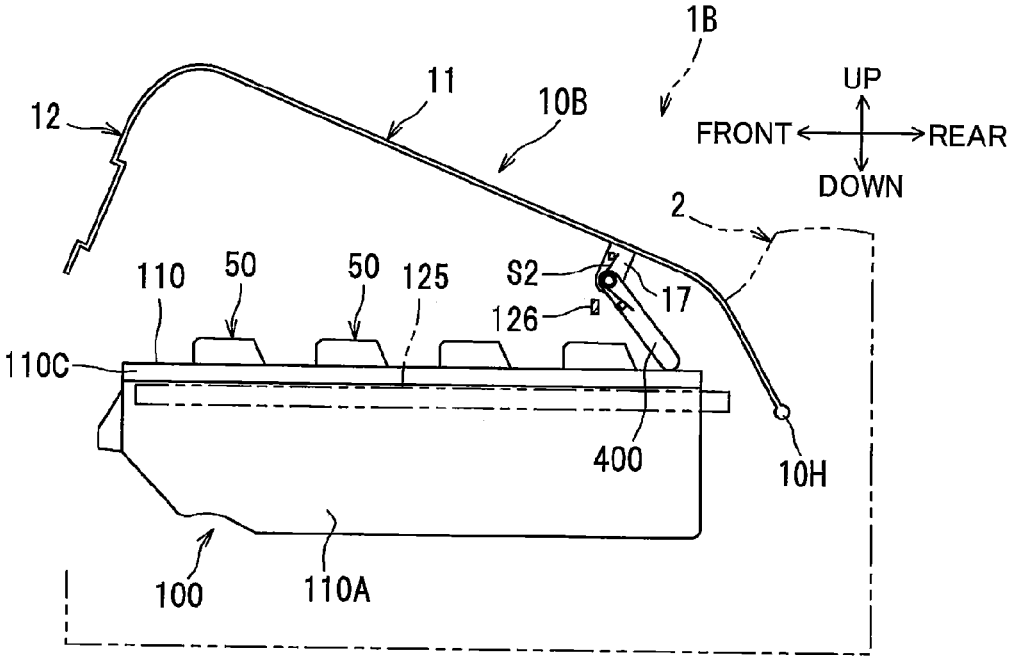
FIG. 10A is a schematic side view illustrating a cover and a restricting member according to a third embodiment of the present invention, wherein a cartridge supporting member according to the third embodiment is in an inside position.

Specifically, in the third embodiment, as shown in FIG. 10A, each side wall 110A of the cartridge supporting member 110 has an upper end portion provided with a guide rib 110C. Each guide rib 110C extends in the front-rear direction and is placed on a rail 125 provided in the main casing 2 as an example of a guide rail. The guide ribs 110C are thus capable of moving relative to and along the rails 125, thereby enabling the cartridge supporting member 110 to move between the inside position and outside position with respect to the front-rear direction.

In the cover 10B, the restricting members 400 are provided on left and right end portions of the top cover 11, respectively. More specifically, the top cover 11 is provided with a pair of mounting portions 17 each protruding downward from the left end portion or right end portion of the top cover 11. Each restricting member 400 has a rod-like shape, and has an upper end pivotably movably supported to the corresponding mounting portion 17.

Each restricting member 400 is configured to be swingable between a restricting position (shown in FIG. 10B) where the restricting member 400 extends vertically relative to the corresponding rail 125 and has a lower end in abutment with the rail 125 from above and an permitting position (shown in FIG. 10A) retracted from the restricting position where the lower end of the restricting member 400 is positioned rearward of a pivot shaft (provided at the upper end of the restricting member 400). The lower end of the restricting member 400 corresponds to another example of the pressed portion.

Figure 10B:
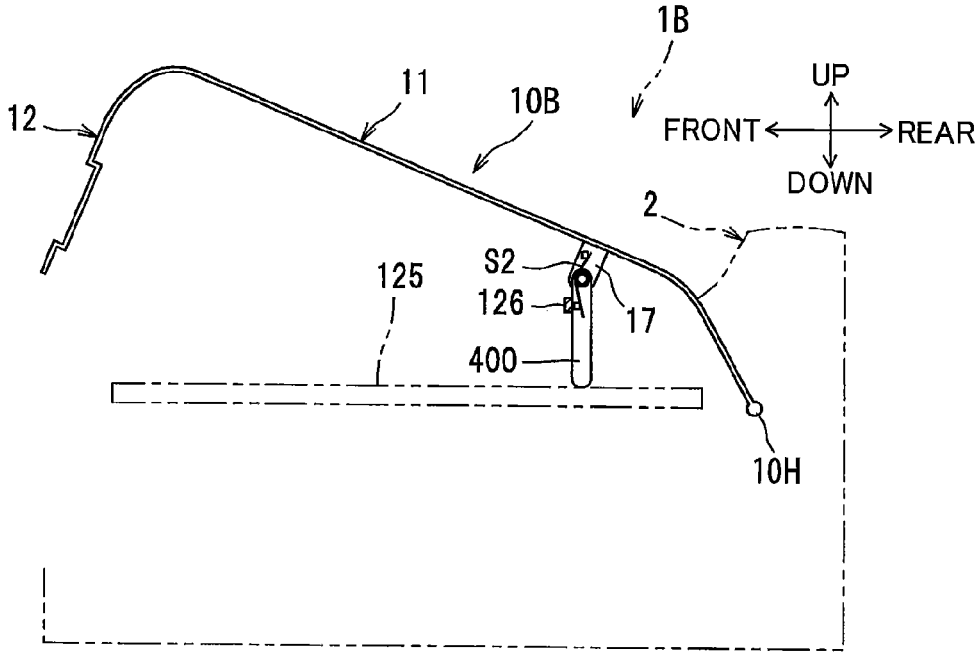
FIG. 10B is a schematic side view illustrating the cover and the restricting member according to the third embodiment, wherein the cartridge supporting member of the third embodiment is in an outside position.

Each restricting member 400 is biased from the permitting position toward the restricting position by a torsion coil spring S2 (as an example of the biasing member) in a clockwise direction in FIGS. 10A and 10B. Specifically, each torsion coil spring S2 includes a coil portion supported by the pivot shaft of the corresponding restricting member 400, one arm engaged with the corresponding mounting portion 17, and another arm engaged with the restricting member 400. The torsion coil springs S2 normally bias (or push) the restricting members 400 frontward. That is, a front end face of each restricting member 400 corresponds to a downstream portion in a biasing direction of the torsion coil spring S2.

The downstream portion of each restricting member 400 in the biasing direction is configured to abut on a stopper 126 provided in the main casing 2 when the cover 10B is opened (displaced at the second position). The restricting members 400 are thus maintained at the restricting position.

Operations and technical advantages of the color printer 1B of the third embodiment will now be described.

As illustrated in FIG. 10A, when the cartridge supporting member 110 is attached to the main casing 2, the restricting members 400 are at the permitting position and the lower ends of the restricting member 400 are respectively in abutment with upper surfaces of the guide ribs 110C of the cartridge supporting member 110. At this time, each lower end of the restricting member 400 is in abutment with a rear end portion of the corresponding guide rib 110C.

Then the cartridge supporting member 110 is withdrawn frontward toward the outside position in the state where the cover 10B is displaced to the second position. The abutment between each restricting member 400 and each guide rib 110C of the cartridge supporting member 110 is released, as illustrated in FIG. 10B, and each restricting member 400 swings toward the restricting position by the biasing force of the corresponding torsion coil spring S2.

When reaching the restricting position, each restricting member 400 is in a stretched state between each mounting portion 17 of the cover 10B and the corresponding rail 125 of the main casing 2. In this state, the restricting members 400 cannot swing even if the mounting portions 17 are attempted to move downward. Hence, downward movement of the cover 10B, that is, movement of the cover 10B toward the first position is restricted. This structure can prevent the cover 10B and LED units 40 from interfering with the image forming unit 100 withdrawn from the main casing 2.

When the restricting members 400 are in the restricting position, the lower ends thereof are placed on the rails 125. In other words, the restricting members 400 fall on a moving path of the guide ribs 110C of the cartridge supporting member 110 moving between the outside position and the inside position. Hence, when the cartridge supporting member 110 is displaced from the outside position to inside position in this state, the guide ribs 110C of the cartridge supporting member 110 abut on the lower ends of the respective restricting members 400 immediately before the cartridge supporting member 110 reaches the inside position, pushing the lower ends of the restricting members 400 rearward. Thus, as illustrated in FIG. 10A, the restricting members 400 are pivotally moved toward the permitting position, thereby enabling the cover 10B to be displaced to the first position.

Various modifications are conceivable.

In the depicted embodiments, the developing cartridge 50 is employed as an example of a cartridge. However, the cartridge may be a drum cartridge provided with the photosensitive drum 115 or a process cartridge integrally including a developing cartridge and a drum cartridge.

In the first embodiment, the pressed surfaces 221 (as an example of the pressed portion) of the restricting members 200 in the restricting position are configured to fall on the moving path of the cartridge supporting member 110 so that the pressed surfaces 221 can be reliably brought into abutment with the cartridge supporting member 110. However, the pressed portions of the restricting members in the restricting position may be configured to fall on a moving path of a cartridge supported by the cartridge supporting member (cartridge supporting member 110). With this configuration as well, the pressed portions can abut on the moving cartridge supported by the cartridge support member.

In the above-described embodiments, the restricting members 200, 300, 400 are provided on both left and right end portions of the cover 10, 10A, 10B. However, a restricting member may be provided at only one of the left and right end portions of the cover 10, 10A, 10B.

In the above embodiments, the outside position is defined as a position where all of the plurality of developing cartridges 50 can be attached to and detached from the cartridge supporting member 110. However, the outside position may be such a position that a part of the cartridge supporting member 110 is disposed inside the main casing 2 and only some of the plurality of developing cartridges 50 are attached to and detached from the cartridge supporting member 110.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main body;

a cartridge supporting member configured to support a plurality of cartridges, the cartridge supporting member being movable along a moving path between an inside position inside the main body and an outside position outside of the main body;

a cover provided at the main body, the cover being pivotally movable between a first position and a second position higher than the first position in a height direction generally perpendicular to the moving path; and a restricting member configured to move in interlocking relation with the movement of the cartridge supporting member, the restricting member being movable between a restricting position for restricting movement of the cover from the second position to the first position and a permitting position for permitting the movement of the cover from the second position to the first position, the restricting member being configured such that the restricting member is placed in the restricting position when the cartridge supporting member is in the outside position and such that the restricting member is placed in the permitting position when the cartridge supporting member is in the inside position.

2. The image forming apparatus as claimed in claim 1, wherein the permitting position is a retracted position retracted from the moving path, while the restricting position is an advanced position advanced into the moving path.

3. The image forming apparatus as claimed in claim 2, further comprising a biasing member configured to bias the restricting member from the permitting position toward the restricting position, wherein the restricting member comprises a pressed portion configured to be positioned on the moving path to allow the cartridge supporting member to abut on the pressed portion while the restricting member is at the restricting position, causing the restricting member to move to the permitting position.

4. The image forming apparatus as claimed in claim 3, wherein the cartridge supporting member is configured to move from the outside position to the inside position in a first moving direction; and wherein the pressed portion comprises a sloped surface sloping to approach the cartridge supporting member toward downstream in the first moving direction, the restricting member being configured to move between the restricting position and the permitting position in a second direction intersecting the first moving direction.

5. The image forming apparatus as claimed in claim 4, wherein the cartridge supporting member comprises a side wall extending in the first moving direction; and wherein the restricting member further comprises an abutment surface extending from the sloped surface and configured to abut on the side wall of the cartridge supporting member at the inside position.

6. The image forming apparatus as claimed in claim 2, wherein the cartridge supporting member is configured to move from the outside position to the inside position in a first moving direction, the cartridge supporting member having a leading end portion in the first moving direction, and the restricting member being configured to abut on the leading end portion at the inside position.

7. The image forming apparatus as claimed in claim 2, wherein the restricting member is provided at the main body.

8. The image forming apparatus as claimed in claim 7, wherein the restricting member is normally urged to the restricting position; and the image forming apparatus further comprising an arm unit comprising:

a shaft portion supported to the main body;

a damper portion having a base end connected to the shaft portion and another end pivotally connected to the main body; and a restricted portion positioned opposite to the damper portion with respect to the shaft portion and having a base end connected to the shaft portion, the damper portion and the restricted portion being integrally pivotally movable about an axis of the shaft portion, the restricted portion being abuttable on the restricting member when the restricting member is moved to the restricting position, an angular position of the restricted portion being maintained by abutment with the restricted portion to maintain the second position of the cover.

9. The image forming apparatus as claimed in claim 7, wherein the restricting member comprises:

a shaft portion supported to the main body;

a first arm having a base end connected to the shaft portion and a free end portion abuttable on the cartridge supporting member; and a second arm positioned opposite to the first arm relative to the shaft portion, and having a base end portion connected to the shaft portion and a distal end portion, the first arm being normally urged to a position on the moving path to maintain the restricting position, the first arm and the second arm being integrally pivotally movable about an axis of the shaft portion; and the image forming apparatus further comprising a restricted portion extending from the cover, the restricted portion being seated on the distal end portion when the second arm is moved to the restricting position to prevent the cover from moving from the second position to the first position.

10. The image forming apparatus as claimed in claim 2, wherein the restricting member is provided at the cover.

11. The image forming apparatus as claimed in claim 10, wherein the main body has a guide rail configured to guide the movement of the cartridge supporting member; and wherein the restricting member comprises a rod member having one end portion pivotally movably connected to the cover and another end portion, the rod member being urged to the restricting position such that the another end portion is seated on the guide rail to prevent the cover from moving from the second position to the first position.

12. The image forming apparatus as claimed in claim 2, wherein the main body comprises a guide portion configured to guide the movement of the restricting member.

13. The image forming apparatus as claimed in claim 2, wherein the cartridge supporting member is configured to move from the inside position to the outside position in a second moving direction, the cartridge supporting member having an leading end portion positioned downstream in the second moving direction; and wherein the cover comprises a covering portion configured to cover the leading end portion of the cartridge supporting member at the inside position when the cover is in the first position.

14. The image forming apparatus as claimed in claim 2, further comprising:

a plurality of photosensitive bodies; and a plurality of exposing members disposed in one-to-one correspondence with the plurality of photosensitive bodies, at least one of the plurality of exposing members being supported to the cover and being positioned between neighboring two of the plurality of cartridges when the cover is in the first position.

* * * * *